US007771909B2

(12) United States Patent
Vong et al.

(10) Patent No.: US 7,771,909 B2
(45) **Date of Patent: *Aug. 10, 2010**

(54) TITANYL PHTHALOCYANINE PHOTOCONDUCTORS

(75) Inventors: Cuong Vong, Hamilton (CA); Ah-Mee Hor, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 933 days.

This patent is subject to a terminal disclaimer.

(21) Appl. No.: 11/602,033

(22) Filed: Nov. 20, 2006

(65) Prior Publication Data

US 2008/0138726 A1 Jun. 12, 2008

(51) Int. Cl.
*G03G 15/02* (2006.01)

(52) U.S. Cl. ..... 430/58.8; 430/59.4; 430/59.5

(58) Field of Classification Search ..... 430/58.8, 430/59.4, 59.5

See application file for complete search history.

(56) References Cited

U.S. PATENT DOCUMENTS

| | | | | |
|---|---|---|---|---|
| 4,921,769 | A | 5/1990 | Yuh et al. | |
| 5,153,094 | A | 10/1992 | Kazmaier et al. | |
| 5,166,339 | A | 11/1992 | Duff et al. | |
| 5,189,155 | A | 2/1993 | Mayo et al. | |
| 5,189,156 | A | 2/1993 | Mayo et al. | |
| 5,252,417 | A * | 10/1993 | Tokida et al. | 430/58.05 |
| 5,473,064 | A | 12/1995 | Mayo et al. | |
| 5,482,811 | A | 1/1996 | Keoshkerian et al. | |
| 5,521,043 | A * | 5/1996 | Listigovers et al. | 430/58.8 |
| 5,521,306 | A | 5/1996 | Burt et al. | |
| 6,376,141 | B1 | 4/2002 | Mishra et al. | |
| 6,713,220 | B2 | 3/2004 | Graham et al. | |
| 6,913,863 | B2 | 7/2005 | Wu et al. | |
| 7,033,715 | B2 | 4/2006 | Molaire | |
| 7,037,631 | B2 | 5/2006 | Wu et al. | |
| 7,485,398 | B2 * | 2/2009 | Wu et al. | 430/58.75 |
| 7,550,239 | B2 * | 6/2009 | Vong et al. | 430/59.5 |
| 7,553,593 | B2 * | 6/2009 | Wu et al. | 430/59.5 |
| 2004/0126685 | A1 * | 7/2004 | Horgan et al. | 430/58.3 |
| 2006/0105254 | A1 | 5/2006 | Wu et al. | |
| 2009/0005555 | A1 * | 1/2009 | Wu | 540/145 |

OTHER PUBLICATIONS

Jin Wu et al., U.S. Appl. No. 11/472,765 on Titanyl Phthalocyanine Photoconductors, filed Jun. 22, 2006.
Jin Wu et al., U.S. Appl. No. 11/472,766 on Titanyl Phthalocyanine Photoconductors, filed Jun. 22, 2006.
Jin Wu et al., U.S. Appl. No. 11/458,467 on Electrophotographic Photoreceptor, filed Jul. 19, 2006.

* cited by examiner

*Primary Examiner*—Thorl Chea
(74) *Attorney, Agent, or Firm*—E. O. Palazzo

(57) ABSTRACT

A photoconductor that includes a photogenerating layer, and at least one charge transport layer where the photogenerating layer contains a titanyl phthalocyanine prepared, for example, by dissolving a Type I titanyl phthalocyanine in a solution comprising a trihaloacetic acid and an alkylene halide; adding the resulting mixture of the dissolved Type I titanyl phthalocyanine to a solution of an alcohol and an alkylene halide thereby precipitating a Type Y titanyl phthalocyanine; and treating the Type Y titanyl phthalocyanine with a monohalobenzene, and wherein the photogenerating layer is prepared from a dispersion of the titanyl phthalocyanine Type V and a chlorinated solvent of at least one of a dichloroethane and a dichloropropane.

29 Claims, 2 Drawing Sheets

TITANYL PHTHALOCYANINE PHOTOCONDUCTORS

CROSS REFERENCE TO RELATED APPLICATIONS

U.S. application Ser. Nos. 11/472,765, now U.S. Pat. No. 7,553,593, and 11/472,766, now U.S. Pat. No. 7,485,398, both filed Jun. 22, 2006, relating to titanyl phthalocyanine photoconductors, the disclosures of which are totally incorporated herein by reference, and wherein there is illustrated, for example, a photoconductor wherein the photogenerating layer contains a titanyl phthalocyanine prepared by dissolving a Type I titanyl phthalocyanine in a solution comprising a trihaloacetic acid and an alkylene halide; adding the mixture comprising the dissolved Type I titanyl phthalocyanine to a solution comprising an alcohol and an alkylene halide thereby precipitating a Type Y titanyl phthalocyanine; and treating the Type Y titanyl phthalocyanine with monohalobenzene.

U.S. Application Ser. No. 11/458,467, U.S. Publication 20080020306, now abandoned, filed Jul. 19, 2006, the disclosure of which is totally incorporated herein by reference, and wherein there is illustrated, for example, a photoconductor wherein the photogenerating layer contains a titanyl phthalocyanine, a film-forming polymer binder; and a glycol compound having two hydroxyl groups bonded to adjoining carbon atoms in the carbon chain.

U.S. application Ser. No. 10/992,500, U.S. Publication No. 20060105254, filed Nov. 18, 2004, the disclosure of which is totally incorporated herein by reference, and wherein there is illustrated, for example, a process for the preparation of a Type V titanyl phthalocyanine, the process comprising providing a Type I titanyl phthalocyanine; dissolving the Type I titanyl phthalocyanine in a solution comprising a trihaloacetic acid and an alkylene halide; adding the resulting mixture comprising the dissolved Type I titanyl phthalocyanine to a solution comprising an alcohol and an alkylene halide thereby precipitating a Type Y titanyl phthalocyanine; and treating the Type Y titanyl phthalocyanine with monochlorobenzene A number of the components of the above cross referenced applications, such as the supporting substrates, resin binders, antioxidants, charge transport components, hole blocking layer components, adhesive layers, titanyl phthalocyanine preparation components and reaction conditions, and the like, may be selected for the photoconductor and imaging members of the present disclosure in embodiments thereof.

BACKGROUND

This disclosure is generally directed to drum and layered imaging members, photoreceptors, photoconductors, and the like. More specifically, the present disclosure is directed to multilayered flexible or belt imaging members or devices comprised of an optional supporting medium like a substrate, a photogenerating layer, and a charge transport layer, including a plurality of charge transports layers, such as a first charge transport layer and a second charge transport layer, an optional adhesive layer, an optional hole blocking or undercoat layer, an optional overcoating layer, and wherein at least one of the charge transport layers contains at least one charge transport component, a polymer or resin binder, and an optional antioxidant. Moreover, the photogenerating layer is comprised of a high sensitivity titanyl phthalocyanine generated by the processes as illustrated in a number of copending applications referenced herein, and more specifically, as illustrated in U.S. application Ser. No. 10/992,500, U.S. Publication No. 20060105254, the disclosure of which is totally incorporated herein by reference.

More specifically, there is illustrated herein in embodiments the incorporation into imaging members of suitable high sensitivity photogenerating pigments, such as certain titanyl phthalocyanines, which sensitivity is, for example, from about 10 to about 50 percent higher than that of a similar photoconductor containing as a photogenerating pigment hydroxygallium phthalocyanine Type V; a hole transport layer thereover, and which layer permits the rapid transport of holes, and wherein the photogenerating dispersion is comprised of a photogenerating pigment or pigments, an optional polymer binder and a chlorinated solvent, such as dichlorinated solvents, which dispersion or mixture is deposited on the photoconductor substrate or other photoconductor layers. The selection of certain chlorinated solvents for the photogenerating dispersion provides a number of advantages such as high dispersion stability and improved potlife. High dispersion stability and improved potlife are particularly desirable from the manufacturing point of view as the dispersion can be used over an extended period of time, like several days, without a negative impact on the coating process and the photosensitivity of the coated photoreceptors. Poor dispersion stability can result in the pigment settling out quickly to prevent or inhibit a uniform coating of the photogenerating layer. When the photosensitivity of coated photoreceptor does not substantially change with the aging of the titanyl phthalocyanine dispersion, then the useful life of the dispersion (potlife) is prolonged allowing efficient utilization of the dispersion materials with minimum waste. Also, the excellent photosensitivity characteristics of the titanyl phthalocyanine obtained can be maintained for suitable periods of time.

Additionally, in embodiments the imaging members disclosed herein possess excellent and in a number of instances low $V_r$ (residual potential), and allow the substantial prevention of $V_r$ cycle up when appropriate; high stable sensitivity; low acceptable image ghosting characteristics; and desirable toner cleanability.

Also included within the scope of the present disclosure are methods of imaging and printing with the photoresponsive or photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, the imaging members and flexible belts disclosed herein can be selected for the Xerox Corporation iGEN3® machines that generate with some versions over 100 copies per minute. Processes of imaging, especially xerographic imaging and printing, including digital, and/or color printing are thus encompassed by the present disclosure.

The imaging members disclosed herein are in embodiments sensitive in the wavelength region of, for example, from about 400 to about 900 nanometers, and in particular from about 650 to about 850 nanometers, thus diode lasers can be selected as the light source. Moreover, the imaging members disclosed herein are in embodiments useful in high resolution color xerographic applications, particularly high-speed color copying and printing processes.

REFERENCES

Disclosed in U.S. Pat. No. 7,033,715 is a process for the formation of a nanoparticulate crystalline titanium phthalocyanine pigment, which can be selected as a photogenerating pigment, by contacting the pigment with substantially pure 1,1,2-trichloroethane (TCE) under conditions so as to convert the titanium phthalocyanine pigment to a nanoparticulate crystalline composition.

There is illustrated in U.S. Pat. No. 7,037,631, the disclosure of which is totally incorporated herein by reference, a photoconductive imaging member comprised of a supporting substrate, a hole blocking layer thereover, a crosslinked photogenerating layer, and a charge transport layer, and wherein the photogenerating layer is comprised of a photogenerating component and a vinyl chloride, allyl glycidyl ether, hydroxy containing polymer.

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components disclosed in the U.S. Pat. No. 4,265,990 patent include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound dispersed in an electrically insulating organic resin binder.

In U.S. Pat. No. 4,921,769, the disclosure of which is totally incorporated herein by reference, there are illustrated photoconductive imaging members with blocking layers of certain polyurethanes.

Illustrated in U.S. Pat. Nos. 6,255,027; 6,177,219, and 6,156,468, the disclosures of which are totally incorporated herein by reference, are, for example, photoreceptors containing a hole blocking layer of a plurality of light scattering particles dispersed in a binder, reference for example, Example I of U.S. Pat. No. 6,156,468, the disclosure of which is totally incorporated herein by reference, wherein there is illustrated a hole blocking layer of titanium dioxide dispersed in a specific linear phenolic binder of VARCUM™, available from OxyChem Company.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water, concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and more specifically, about 19 parts with 1,3-diiminoisoindolene ($DI^3$) in an amount of from about 1 part to about 10 parts, and more specifically, about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

The process for the preparation of photoreceptors using dispersions is susceptible to many variables, such as, for example, material variables, including contents and purity of the material; the photogenerating dispersion components selected and amounts thereof; process variables, including milling time and milling procedure; and coating process variables, including web coating, dip coating, the drying process of several layers, the time interval between the coatings of successive layers, and the like. The net outcome of these variables is, for example, that the electrical characteristics of the prepared photoreceptors may be inconsistent during the manufacturing process.

Sensitivity is a valuable electrical characteristic of electrophotographic imaging members or photoreceptors. Sensitivity may be described in two aspects. The first aspect of sensitivity is spectral sensitivity, which refers to sensitivity as a function of wavelength. An increase in spectral sensitivity implies an appearance of sensitivity at a wavelength in which previously no sensitivity was detected. The second aspect of sensitivity, broadband sensitivity, is a change of sensitivity, for example an increase at a particular wavelength previously exhibiting sensitivity, or a general increase of sensitivity encompassing all wavelengths previously exhibiting sensitivity. This second aspect of sensitivity may also be considered as change of sensitivity, encompassing all wavelengths, with a broadband (white) light exposure. A problem encountered in the manufacturing of photoreceptors is maintaining consistent spectral and broadband sensitivity from batch to batch.

Typically, flexible photoreceptor belts are fabricated by depositing the various layers of photoactive coatings onto long webs that are thereafter cut into sheets. The opposite ends of each photoreceptor sheet are overlapped and ultrasonically welded together to form an imaging belt. In order to increase throughput during the web coating operation, the webs to be coated have a width of twice the width of a final belt. After coating, the web is slit lengthwise, and thereafter transversely cut into predetermined lengths to form photoreceptor sheets of precise dimensions that are eventually welded into belts. The web length in a coating run may be many thousands of feet long and the coating run may take more than an hour for each layer.

Various types of inorganic photoconductive pigments are known, including pigments based on phthalocyanines. A variety of phthalocyanine-based pigments are suitable for use in photoimaging members, including metal-free phthalocyanines, copper, iron, and zinc phthalocyanines, chloroindium phthalocyanines, hydroxygallium phthalocyanines, certain titanium-based phthalocyanines, such as, for example, titanyl phthalocyanine Type IV, and compositions comprising combinations of the above pigments. U.S. Pat. No. 6,376,141, the entire disclosure of which is incorporated herein by reference, illustrates various compositions comprising combinations of phthalocyanine pigments including hydroxygallium phthalocyanine pigments. Additionally, for example, U.S. Pat. No. 6,713,220, the disclosure of which is totally incorporated herein by reference, discloses a method of preparing a Type V hydroxygallium phthalocyanine.

A number of titanyl phthalocyanines, oxytitanium phthalocyanines, or photogenerating pigments are known to absorb near infrared light around 800 nanometers and may exhibit improved sensitivity compared to other pigments, such as, for example, hydroxygallium phthalocyanine. Generally, titanyl phthalocyanine is known to have five main crystal forms known as Types I, II, III, X, and IV. For example, U.S. Pat. Nos. 5,189,155 and 5,189,156, the entire disclosures of which are incorporated herein by reference, disclose a number of methods for obtaining various polymorphs of titanyl phthalocyanine. Additionally, U.S. Pat. Nos. 5,189,155 and 5,189,156 are directed to processes for obtaining Types I, X, and IV phthalocyanines. U.S. Pat. No. 5,153,094, the entire disclosure of which is incorporated herein by reference, relates to the preparation of titanyl phthalocyanine polymorphs including Types I, II, III, and IV polymorphs. U.S. Pat. No. 5,166,339, the disclosure of which is totally incorporated herein by reference, discloses processes for preparing Types I, IV, and X titanyl phthalocyanine polymorphs, as well as the preparation of two polymorphs designated as Type Z-1 and Type Z-2.

SUMMARY

Figure 1:
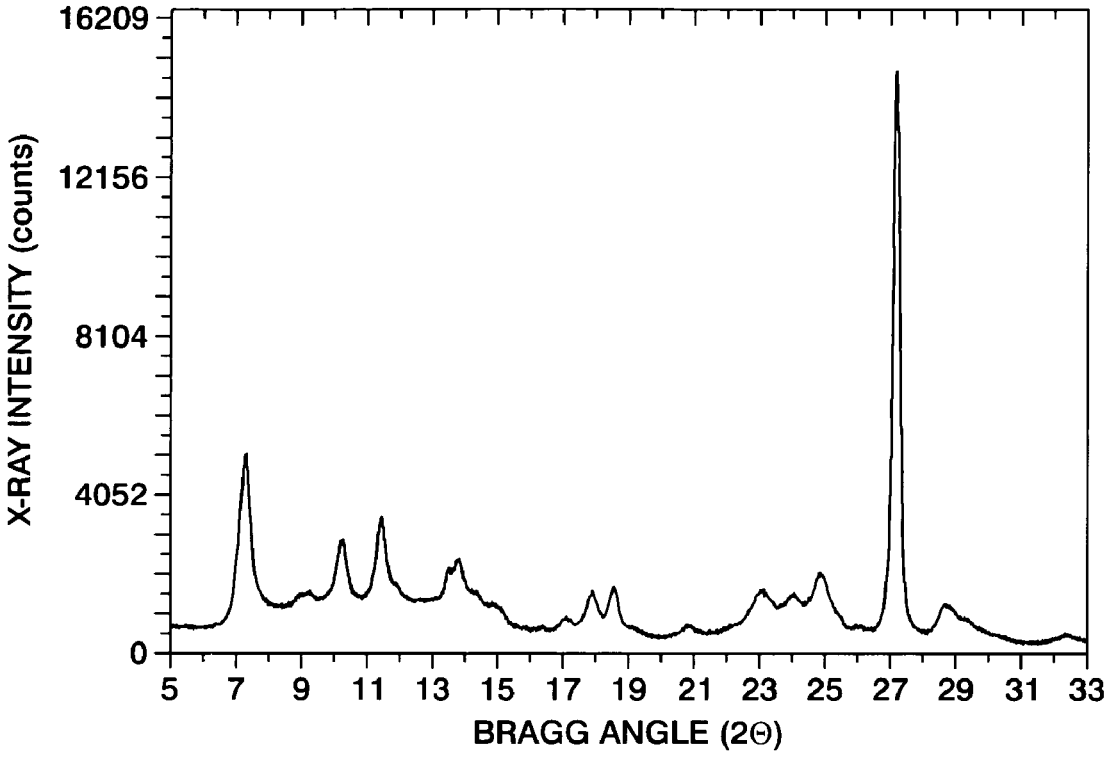
FIG. 1 represents a diffractograph summary of an XRPD of a Type Y titanyl phthalocyanine (TiOPc) with no MCB (monochlorobenzene) conversion.
Figure 2:
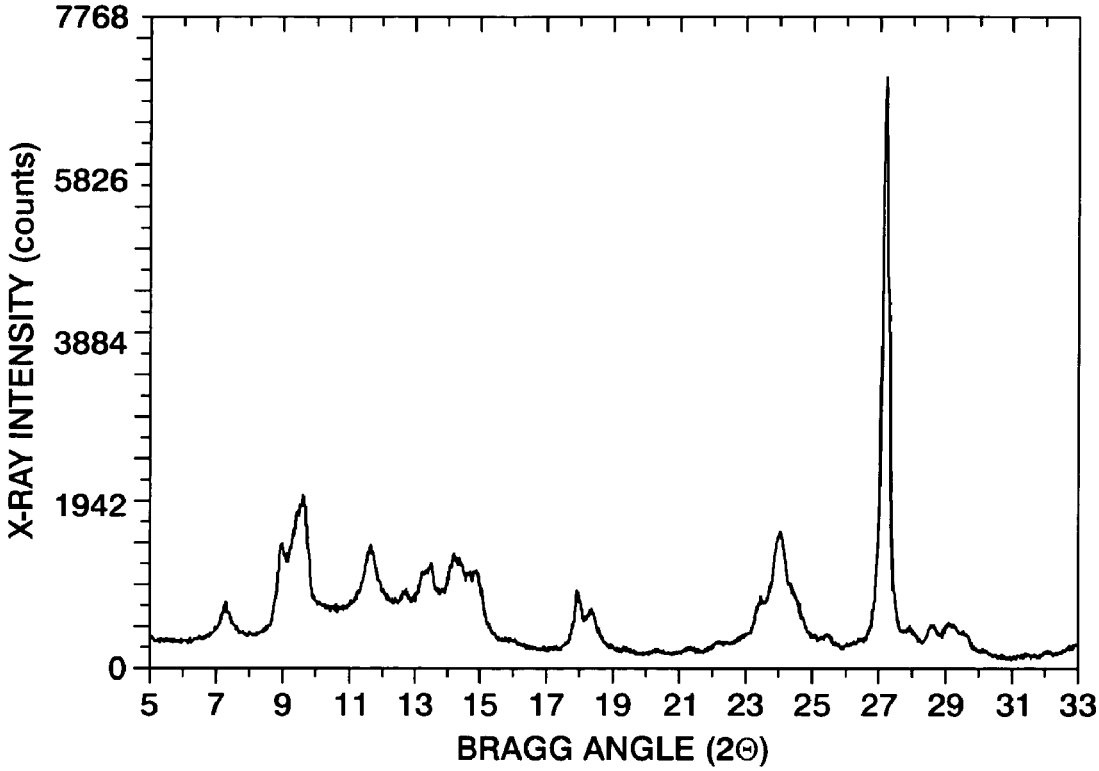
FIG. 2 represents a diffractograph summary of an XRPD of a Type V titanyl phthalocyanine with a MCB conversion of about 3 hours.

Disclosed are imaging members with many of the advantages illustrated herein, such as extended lifetimes of service of, for example, in excess of about 3,000,000 imaging cycles; rapid charge transfer to thereby improve print quality caused by temperature variation in proximity to the photoconductor; excellent electrical characteristics, for example high sensitivity; stable electrical properties; low image ghosting; resistance to charge transport layer cracking upon exposure to the vapor of certain solvents; excellent surface characteristics; improved wear resistance; compatibility with a number of toner compositions; consistent $V_r$ (residual potential) that is substantially flat or no change over a number of imaging cycles as illustrated by the generation of known PIDC (Photoinduced Discharge Curve); stable photogenerating dispersions, extended pot life and excellent optical absorption properties thereof, and the like.

Also disclosed are layered photoresponsive imaging members, which are responsive to near infrared radiation of from about 700 to about 900 nanometers.

Further disclosed are drum or layered flexible photoresponsive imaging members.

Moreover, disclosed are layered belt and drum photoresponsive or photoconductive imaging members with mechanically robust and solvent resistant charge transport layers and with rapid transport of charge, especially holes.

Additionally disclosed are flexible imaging members with optional hole blocking layers comprised of metal oxides, phenolic resins, and optional phenolic compounds, and which phenolic compounds contain at least two, and more specifically, two to ten phenol groups or phenolic resins with, for example, a weight average molecular weight of, for example, from about 500 to about 3,000, permitting, for example, a hole blocking layer with excellent efficient electron transport which usually results in a desirable photoconductor low residual potential $V_{low}$.

Also disclosed are photoconductors with rapid charge transporting characteristics, high and stable, with a minimum or no PIDC change, photosensitivity, and which sensitivity is in embodiments about 50 percent higher than similar photoconductors that contain, for example, in the photogenerating layer a hydroxygallium phthalocyanine.

Embodiments

Aspects of the present disclosure relate to a photoconductor containing an optional supporting substrate, a photogenerating layer, and at least one charge transport layer comprised of at least one charge transport component wherein the at least one charge transport component is comprised, for example, of aryl amine molecules of the formula

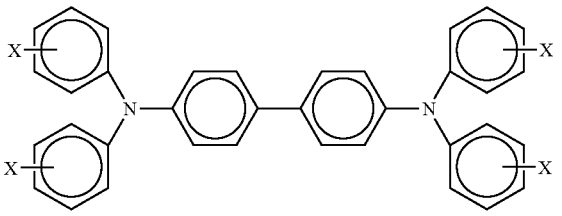

wherein each X is a suitable hydrocarbon like alkyl, alkoxy, aryl, and substituted derivatives thereof; halogen, or mixtures thereof, and wherein the photogenerating layer contains a titanyl phthalocyanine prepared by dissolving a Type I titanyl phthalocyanine in a solution comprising a trihaloacetic acid and an alkylene halide; adding the mixture comprising the dissolved Type I titanyl phthalocyanine to a solution comprising an alcohol and an alkylene halide thereby precipitating a Type Y titanyl phthalocyanine; and treating or contacting the Type Y titanyl phthalocyanine with a monohalobenzene, and thereafter forming a dispersion of the titanyl phthalocyanine, which dispersion contains a polymer binder and certain chlorinated solvents followed by applying the dispersion to the photoconductor substrate; a photoconductor comprised in sequence of a substrate, a photogenerating layer thereover, and a charge transport layer, and wherein the photogenerating layer contains a titanyl phthalocyanine Type V prepared by dissolving a Type I titanyl phthalocyanine in a solution comprising a trihaloacetic acid and an alkylene halide; adding the mixture to a solution comprising an alcohol and an alkylene halide thereby precipitating a Type Y titanyl phthalocyanine; and contacting the Type Y titanyl phthalocyanine with a monohalobenzene, and thereafter forming a dispersion of the titanyl phthalocyanine, which dispersion contains a polymer binder and certain chlorinated solvents followed by applying the dispersion to the photoconductor substrate, and optionally wherein the charge transport layer includes an antioxidant; and a process for the preparation of a photoconductor which comprises applying or depositing a dispersion of a photogenerating pigment and certain chlorinated solvents on the appropriate photoconductor layer such as the supporting substrate, the hole blocking layer, the adhesive layer, or the charge transport layer; a photoconductor comprising an optional supporting substrate, a photogenerating layer, and at least one charge transport layer comprised of at least one charge transport component, and wherein the photogenerating layer contains a titanyl phthalocyanine prepared by dissolving a Type I titanyl phthalocyanine in a solution comprising a trihaloacetic acid and an alkylene halide; adding a mixture comprising the dissolved Type I titanyl phthalocyanine to a solution comprising an alcohol and an alkylene halide thereby precipitating a Type Y titanyl phthalocyanine; and treating said Type Y titanyl phthalocyanine with a monohalobenzene and wherein the photogenerating layer is prepared from a dispersion of the titanyl phthalocyanine, a polymer binder, and a chlorinated solvent of at least one of dichloroethane and dichloropropane; a photoconductor comprised in sequence of a substrate, a photogenerating layer thereover, and a charge transport layer, and wherein the photogenerating layer, which is prepared from a titanyl phthalocyanine, a polymer binder, and at least one of dichloroethane and dichloropropane, is deposited on the substrate; and a process for the preparation of a photoconductor member which comprises depositing on a substrate a dispersion of a mixture of a suitable titanyl phthalocyanine photogenerating pigment, a resin binder, and at least one of dichloroethane, and dichloropropane; and thereafter coating the photogenerating layer with a charge transport layer.

Chlorinated solvents selected for the photogenerating dispersion include dichloroalkanes, and more specifically, 1,2-dichloroethane, 1,2-dichloropropane, 1,3-dichloropropane, 1,2-dichlorobutane, 2,3-dichlorobutane, 1,3-dichlorobutane, and mixtures thereof. The photogenerating dispersion is comprised, for example, of a mixture containing from about 1 weight percent to about 10 weight percent of a photogenerating pigment, from 80 weight percent to about 98 weight percent of chlorinated solvent, and from 1 weight percent to about 10 weight percent polymer binder. More specifically, the photogenerating mixture contains from about 2 weight percent to about 6 weight percent of a TiOPc Type V photogenerating pigment, from about 90 weight percent to about 96 weight percent of chlorinated solvent, and from about 2 weight percent to about 6 weight percent of polymer binder. The specific dichloroalkane solvents selected preserve the high photosensitivity of the TiOPc pigment, such as Type V or Type IV, in dispersion mixture for more than 100 hours, such as from about 101 to about 140 hours, whereas when nonchlorinated solvents are selected, such as tetrahydrofuran, dioxolane, can cause a serious deterioration of photosensitivity, up to an extent of a 50 percent loss. This rapid loss may impose a severe time constraint on photoreceptor manufacturing processes as the useful potlife of a pigment dispersion is rather limited as disclosed herein. It is believed that the chlorinated solvents disclosed do not substantially alter the crystal structure of the high photosensitivity TiOPc. Also, it is generally known that the photosensitivity of phthalocyanines, including TiOPc, depends on its crystal structure. Tetrahydrofuran and dioxolane can convert the high sensitivity crystal structure into a lower sensitivity form. The photoreceptors incorporating a high photosensitivity TiOPc pigment are particularly suitable for high speed electrophotography printing applications as less exposure energy from a laser ROS (raster-optical scanning) system is needed to image them.

The photogenerating layer in embodiments is comprised of high photosensitivity titanyl phthalocyanines prepared as illustrated herein. In embodiments, the Type V phthalocyanine can be generated by dissolving Type I titanyl phthalocyanine in a solution comprising a trihaloacetic acid and an alkylene halide; adding the resulting mixture comprising the dissolved Type I titanyl phthalocyanine to a solution comprising an alcohol and an alkylene halide thereby precipitating a Type Y titanyl phthalocyanine; and treating the resulting Type Y titanyl phthalocyanine with monochlorobenzene.

With further respect to the titanyl phthalocyanines selected for the photogenerating layer, such phthalocyanines exhibit a crystal phase that is distinguishable from other known titanyl phthalocyanine polymorphs, and are designated as Type V polymorphs prepared by converting a Type I titanyl phthalocyanine to a Type V titanyl phthalocyanine pigment. The processes include converting a Type I titanyl phthalocyanine to an intermediate titanyl phthalocyanine, which is designated as a Type Y titanyl phthalocyanine, and then subsequently converting the Type Y titanyl phthalocyanine to a Type V titanyl phthalocyanine.

In one embodiment, the process comprises (a) dissolving a Type I titanyl phthalocyanine in a suitable solvent; (b) adding the solvent solution comprising the dissolved Type I titanyl phthalocyanine to a quenching solvent system to precipitate an intermediate titanyl phthalocyanine (designated as a Type Y titanyl phthalocyanine); and (c) treating the resultant Type Y phthalocyanine with a halo, such as, for example, monochlorobenzene to obtain a resultant high sensitivity titanyl phthalocyanine, which is designated herein as a Type V titanyl phthalocyanine. In another embodiment, prior to treating the Type Y phthalocyanine with a halo, such as monochlorobenzene, the Type Y titanyl phthalocyanine may be washed with various solvents including, for example, water, and/or methanol. The quenching solvents system to which the solution comprising the dissolved Type I titanyl phthalocyanine is added comprises, for example, an alkyl alcohol and an alkylene halide.

The process further provides a titanyl phthalocyanine having a crystal phase distinguishable from other known titanyl phthalocyanines. The titanyl phthalocyanine Type V prepared by a process according to the present disclosure is distinguishable from, for example, Type IV titanyl phthalocyanines in that a Type V titanyl phthalocyanine exhibits an X-ray powder diffraction spectrum having four characteristic peaks at 9°, 9.6°, 24°, and 27.2°, while Type IV titanyl phthalocyanines typically exhibit only three characteristic peaks at 9.6°, 24°, and 27.2°.

A number of Type I titanyl phthalocyanines may be selected for the generation of the Type V titanyl phthalocyanine, such as the Type Is prepared as illustrated in U.S. Pat. Nos. 5,153,094; 5,166,339; 5,189,155; and 5,189,156, the disclosures of which are totally incorporated herein by reference. More specifically, a Type I titanyl phthalocyanine may be prepared, in embodiments, by the reaction of $DI^3$ (1,3-diiminoisoindolene) and tetrabutoxide in the presence of 1-chloronaphthalene solvent, whereby there is obtained a crude Type I titanyl phthalocyanine, which is subsequently purified up to about a 99.5 percent purity by washing with, for example, dimethylformamide.

In another embodiment, for example, a Type I titanyl phthalocyanine can also be prepared by i) the addition of 1 part titanium tetrabutoxide to a stirred solution of from about 1 part to about 10 parts, and in embodiments about 4 parts of 1,3-diiminoisoindolene; ii) relatively slow application of heat using an appropriate sized heating mantle at a rate of about 1° C. per minute to about 10° C. per minute and, in embodiments, about 5° C. per minute until refluxing occurs at a temperature of about 130° C. to about 180° C. (all temperatures are in Centigrade unless otherwise indicated); iii) removal and collection of the resulting distillate, which was shown by NMR spectroscopy to be butyl alcohol, in a dropwise fashion using an appropriate apparatus, such as a Claisen Head condenser, until the temperature of the reactants reaches from about 190° C. to about 230° C., and in embodiments, about 200° C.; iv) continued stirring at the reflux temperature for a period of about ½ hour to about 8 hours, and in embodiments, about 2 hours; v) cooling the reactants to a temperature of about 130° C. to about 180° C., and in embodiments, about 160° C. by removal of the heat source; vi) filtration of the flask contents through, for example, an M-porosity (10 to 15 microns) sintered glass funnel which was preheated using a solvent, which is capable of raising the temperature of the funnel to about 150° C., for example, a solvent of boiling N,N-dimethylformamide in an amount sufficient to substantially completely cover the bottom of the filter funnel so as to prevent blockage of the funnel; vii) washing the resulting purple solid by slurrying the solid in portions of boiling DMF either in the funnel or in a separate vessel in a ratio of about 1 to about 10, and more specifically; viii) cooling and further washing the solid of impurities by slurrying the washing solid in portions of N,N-dimethylformamide at room temperature, about 25° C., approximately equivalent to about three times blue in color; ix) washing the solid of impurities by slurrying the solid in portions of an organic solvent, such as methanol, acetone, water, and the like, and in this embodiment, methanol, at room temperature (about 25° C.), approximately equivalent to about three times the volume of the solid being washed until the filtrate became light blue in color; x) oven drying the solid in the presence of a vacuum or in air at a temperature of from about 25° C. to about 200° C., and in embodiments at about 70° C. for a period of from about 2 hours to about 48 hours, and in embodiments, for about 24 hours, thereby resulting in the isolation of a shiny purple solid, which was identified as being Type I titanyl phthalocyanine by its X-ray powder diffraction trace.

In still another embodiment, a Type I titanyl phthalocyanine may be prepared by (1) reacting a $DI^3$ with a titanium tetra alkoxide, such as, for example, titanium tetrabutoxide at a temperature of about 195° C. for about two hours; (ii) filtering the contents of the reaction to obtain a resulting solid; (iii) washing the solid with dimethylformamide (DMF); (iv) washing with four percent ammonium hydroxide; (v) washing with deionized water; (vi) washing with methanol; (vii) reslurrying the washes and filtering; and (viii) drying at about 70° C. under vacuum to obtain a Type I titanyl phthalocyanine.

In a process embodiment for preparing a high sensitivity phthalocyanine in accordance with the present disclosure, a Type I titanyl phthalocyanine is dissolved in a suitable solvent. In embodiments, a Type I titanyl phthalocyanine is dissolved in a solvent comprising a trihaloacetic acid and an alkylene halide. The alkylene halide comprises, in embodiments, from about one to about six carbon atoms. An example of a suitable trihaloacetic acid includes, but is not limited to, trifluoroacetic acid. In one embodiment, the solvent for dissolving the Type I titanyl phthalocyanine comprises trifluoroacetic acid and methylene chloride. In embodiments, the trihaloacetic acid is present in an amount of from about one volume part to about 100 volume parts of the solvent, and the alkylene halide is present in an amount of from about one volume part to about 100 volume parts of the solvent. The solvent in embodiments comprises methylene chloride and trifluoroacetic acid in a volume-to-volume ratio of about 4 to 1. The Type I titanyl phthalocyanine is dissolved in the solvent by stirring for an effective period of time, such as, for example, for about 30 seconds to about 24 hours, at room temperature. The Type I titanyl phthalocyanine may be dissolved in the solvent in either air or in an inert atmosphere (argon or nitrogen).

The Type I titanyl phthalocyanine can be converted to an intermediate titanyl phthalocyanine form prior to conversion to the high sensitivity titanyl phthalocyanine pigment. "Intermediate" in embodiments refers, for example, that the Type Y titanyl phthalocyanine is a separate form prepared prior to obtaining the final desired Type V titanyl phthalocyanine product. For example, to obtain the intermediate form, which is designated as a Type Y titanyl phthalocyanine, the dissolved Type I titanyl phthalocyanine is added to a quenching system comprising an alkyl alcohol, alkyl including, for example, carbon chain lengths of from about 1 to about 12 carbon atoms, and alkylene halides, such as an alkylene chloride. Adding the dissolved Type I titanyl phthalocyanine to the quenching system or quenching mixture causes the Type Y titanyl phthalocyanine to precipitate. Materials suitable as the alkyl alcohol component of the quenching system include, but are not limited to, methanol, ethanol, propanol, butanol, and the like. In embodiments, the alkylene chloride component of the quenching system comprises from about 1 to about 10 carbon atoms. In embodiments, the quenching system comprises methanol and methylene chloride. The quenching system comprises an alkyl alcohol to alkylene chloride ratio of from about 1/4 to about 4/1 (v/v). In other embodiments, the ratio of alkyl alcohol to alkylene chloride is from about 1/1 to about 3/1 (v/v). In an embodiment, the quenching system comprises methanol and methylene chloride in a ratio of about 1/1 (v/v). In another embodiment, the quenching system comprises methanol and methylene chloride in a ratio of about 3/1 (v/v). In embodiments, the dissolved Type I titanyl phthalocyanine is added to the quenching system at a rate of from about 1 milliliter/minute to about 100 milliliters/minute, and the quenching system is maintained at a temperature of from about 0° C. to about −25° C. during quenching. In a further embodiment, the quenching system is maintained at a temperature of from about 0° C. to about −25° C. for a period of from about 0.1 hour to about 8 hours after addition of the dissolved Type I titanyl phthalocyanine solution.

Following precipitation of the Type Y titanyl phthalocyanine, the precipitates may be washed with any suitable solution including, for example, methanol, cold deionized water, hot deionized water, and the like. Generally, washing the precipitate is also accompanied by filtration. A wet cake containing Type Y titanyl phthalocyanine and water is obtained with the water content varying from about 30 to about 70 weight percent of the wet cake. The Type V titanyl phthalocyanine is obtained by treating the obtained intermediate Type Y titanyl phthalocyanine with a halo, such as, for example, monochlorobenzene. The Type Y titanyl phthalocyanine wet cake may be redispersed in monochlorobenzene, filtered and oven-dried at a temperature of from about 60° C. to about 85° C. to provide the resultant Type V titanyl phthalocyanine. The monochlorobenzene treatment may occur over a period of about 1 hour to about 24 hours. In one embodiment, the monochlorobenzene treatment is accomplished for a period of about five hours.

A titanyl phthalocyanine obtained in accordance with embodiment processes of the present disclosure, which is designated as a Type V titanyl phthalocyanine, exhibits an X-ray powder diffraction spectrum distinguishable from a number of other known titanyl phthalocyanine polymorphs. A Type V titanyl phthalocyanine obtained exhibits in embodiments an X-ray diffraction spectrum having four characteristic peaks at 9°, 9.6°, 24°, and 27.2°. A titanyl phthalocyanine prepared by a process in accordance with the present disclosure may have a particle size diameter of from about 10 nanometers to about 500 nanometers. Particle size may be controlled or affected by the quenching rate when adding the dissolved Type I titanyl phthalocyanine to the quenching system and the composition of the quenching system.

Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 micron to about 30 microns, or to about 10 microns, and more specifically, from about 0.25 micron to about 2 microns when, for example, the photogenerating compositions are present in an amount of from about 30 to about 75 percent by volume. The maximum thickness of this layer in embodiments is dependent primarily upon factors, such as photosensitivity, electrical properties, and mechanical considerations. The photogenerating layer binder resin includes those polymers as disclosed in U.S. Pat. No. 3,121,006, the disclosure of which is totally incorporated herein by reference, and is present in various suitable amounts, for example from about 1 to about 50 weight percent, and more specifically, from about 1 to about 10 weight percent, and which resin may be selected from a number of known polymers such as poly (vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific examples of coating solvents are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

In embodiments the photogenerating layer may contain in addition to the high sensitivity titanyl phthalocyanine other known photogenerating pigments like metal phthalocyanines, metal free phthalocyanines, alkylhydroxyl gallium phthalocyanines, hydroxygallium phthalocyanines, chlorogallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. Generally, in embodiments the photoconductor is comprised of the above photogenerating layer deposited on a supporting substrate, and which layer can be situated between the at least one charge transport layer and the substrate.

The thickness of the photoconductor substrate layer depends on many factors, including economical considerations, electrical characteristics, and the like, thus this layer may be of substantial thickness, for example over 3,000 microns, such as from about 300 to about 700 microns, or of a minimum thickness. In embodiments, the thickness of this layer is from about 75 microns to about 300 microns, or from about 100 microns to about 150 microns.

The substrate may be opaque or substantially transparent and may comprise any suitable material inclusive of known materials with suitable mechanical properties. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating, or conductive substrate may be in the form of an endless flexible belt, a web, a rigid cylinder, a sheet, and the like. The thickness of the substrate layer depends on numerous factors, including strength desired and economical considerations. For a drum, as disclosed in a copending application referenced herein, this layer may be of a substantial thickness of, for example, up to many centimeters or of a minimum thickness of less than a millimeter. Similarly, a flexible belt may be of a substantial thickness, for example about 250 micrometers, or of a minimum thickness of less than 50 micrometers, provided there are no adverse effects on the final electrophotographic device.

Illustrative examples of substrates are as illustrated herein, and can comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example, polycarbonate materials commercially available as MAKROLON®.

Various resins can be used as electrically nonconducting substrate materials, including, but not limited to, polyesters, polycarbonates, polyamides, polyurethanes, and the like. Examples of suitable substrate materials include, but are not limited to, a commercially available biaxially oriented polyester known as MYLAR™, available from E.I. DuPont de Nemours & Company, MELINEX™, available from ICI Americas Inc., or HOSTAPHAN™, available from American Hoechst Corporation. Other materials of which the substrate may be comprised include polymeric materials, such as polyvinyl fluoride, available as TEDLAR™ from E.I. DuPont de Nemours & Company, polyethylene and polypropylene, available as MARLEX™ from Phillips Petroleum Company, polyphenylene sulfide, RYTON™, available from Phillips Petroleum Company, and polyimides, available as KAPTON™ from E.I. DuPont de Nemours & Company. The photoreceptor can also be coated on an insulating plastic drum, provided a conducting ground plane has previously been coated on its surface, as described above. Such substrates can either be seamed or seamless.

When a conductive substrate is employed, any suitable conductive material can be selected. For example, the conductive material can include, but is not limited to, metal flakes, powders or fibers, such as aluminum, titanium, nickel, chromium, brass, gold, stainless steel, carbon black, graphite, or the like, in a binder resin including metal oxides, sulfides, silicides, quaternary ammonium salt compositions, conductive polymers, such as polyacetylene or its pyrolysis, and molecular doped products, charge transfer complexes, polyphenyl silane, and molecular doped products from polyphenyl silane. A conducting plastic drum or a conducting metal drum of a material, such as aluminum, can be selected as the substrate.

A number of known charge transport components can be selected for the charge transport layer, such as aryl amines, which layer is generally of a thickness of from about 5 microns to about 75 microns, and more specifically, of a thickness of from about 10 microns to about 40 microns, including molecules of the following formula

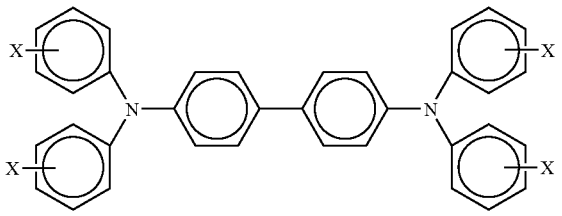

wherein each X is a suitable hydrocarbon like alkyl, alkoxy, aryl, and substituted derivatives thereof; a halogen, and especially those substituents selected from the group consisting of Cl and $CH_3$; molecules of the following formula

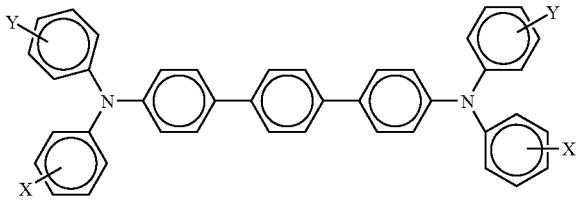

wherein X and Y are independently alkyl, alkoxy, aryl, a halogen, or mixtures thereof. Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, and the like. Other known charge transport layer molecules can be selected, reference for example U.S. Pat. Nos. 4,921,773 and 4,464,450, the disclosures of which are totally incorporated herein by reference.

The charge transport layer or layers, and more specifically, a first charge transport in contact with the photogenerating layer, and thereover a top or second charge transport overcoating layer may comprise the illustrated charge transporting small molecules dissolved or molecularly dispersed in a film forming electrically inert polymer such as a polycarbonate. In embodiments, dissolved refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale.

Examples of hole transporting molecules for the at least one charge transport layer, such as the first and second charge transport layer, are as indicated herein and include, for example, known hole transport components; aryl amines such as N,N'-diphenyl-N,N'-bis(3-methylphenyl)-(1,1'-biphenyl)-4,4'-diamine, N,N'-diphenyl-N,N-bis(4-methylphenyl)-1,1'-biphenyl-4,4'-diamine, N,N'-diphenyl-N,N-bis(2-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, optionally mixtures thereof, and the like. In embodiments, to minimize or avoid cycle-up in equipment, such as printers, with high throughputs, it is sometimes desirable that the charge transport layer be substantially free (less than about two percent) of a di or triamino-triphenyl methane. The electrically active small molecule charge transporting compounds are dissolved or molecularly dispersed in electrically inactive polymeric film forming materials. A small molecule charge transporting compound that permits injection of holes into the photogenerating layer with high efficiency, and transports them across the charge transport layer with short transit times specifically includes N,N'-diphenyl-N,N'-bis(3-methylphenyl)-(1,1'-biphenyl)-4,4'-diamine, N,N'-diphenyl-N,N-bis(4-methylphenyl)-1,1'-biphenyl-4,4'-diamine, N,N'-diphenyl-N,N-bis(2-methylphenyl)-1,1'-biphenyl-4,4'- diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, or N,N'-diphenyl-N,N'-bis(3-chlorophenyl)-[p-terphenyl]-4,4"-diamine. If desired, the charge transport material in the charge transport layer may comprise a polymeric charge transport material, or a combination of a small molecule charge transport material and a polymeric charge transport material.

The charge transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be maintained from about 2:1 to about 200:1, and in some instances as great as 400:1. The charge transport layer is substantially nonabsorbing to visible light or radiation in the region of intended use, but is electrically "active" in that it allows the injection of photogenerated holes from the photoconductive layer, that is the photogenerating layer, and allows these holes to be transported through itself to selectively discharge a surface charge on the surface of the active layer.

The thickness of the charge transport overcoat layer selected depends, for example, upon the abrasiveness of the charging (bias charging roll), cleaning (blade or web), development (brush), transfer (bias transfer roll), and the like in the system employed, and can be up to about 10 micrometers. In embodiments, this thickness for each layer is from about 1 micrometer to about 5 micrometers. Various suitable and conventional methods may be used to mix, and thereafter apply the overcoat layer coating mixture to the photogenerating layer. Typical application techniques include spraying, dip coating, roll coating, wire wound rod coating, and the like. Drying of the deposited coating may be effected by any suitable conventional technique such as oven drying, infrared radiation drying, air drying, and the like. The dried overcoating layer of this disclosure should transport holes during imaging, and should not have too high a free carrier concentration. Free carrier concentration in the overcoat increases the dark decay.

The overcoat layer or layers can comprise the same components as the charge transport layer wherein the weight ratio between the charge transporting small molecule, and the suitable electrically inactive resin binder is less, such as for example, from about 0/100 to about 60/40, or from about 20/80 to about 40/60.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof. In embodiments, electrically inactive binders are comprised of polycarbonate resins with, for example, a molecular weight of from about 20,000 to about 100,000, and more specifically, with a molecular weight $M_w$ of from about 50,000 to about 100,000. Examples of polycarbonates are poly(4,4'-isopropylidene-diphenylene)carbonate (also referred to as bisphenol-A-polycarbonate), poly(4,4'-cyclohexylidinediphenylene)carbonate (referred to as bisphenol-Z polycarbonate), poly(4,4'-isopropylidene-3,3'-dimethyldiphenyl)carbonate (also referred to as bisphenol-C-polycarbonate), and the like.

The optional hole blocking or undercoat layer for the imaging members of the present disclosure can contain a number of components, including known hole blocking components, such as amino silanes, doped metal oxides, TiSi, a metal oxide like titanium, chromium, zinc, tin, and the like; a mixture of phenolic compounds and a phenolic resin, or a mixture of two phenolic resins; and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylenediisopropylidene)bisphenol), S (4,4'-sulfonyldiphenol), Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound, and yet more specifically, containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9 nanometers. To the above dispersion, a phenolic compound and dopant are added followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM® 29159 and 29101 (available from OxyChem Company), and DURITE® 97 (available from Borden Chemical), formaldehyde polymers with ammonia, cresol and phenol, such as VARCUM® 29112 (available from OxyChem Company), formaldehyde polymers with 4,4'-(1-methylethylidene)bisphenol, such as VARCUM™ 29108 and 29116 (available from OxyChem Company), formaldehyde polymers with cresol and phenol, such as VARCUM® 29457 (available from OxyChem Company), DURITE® SD-423A, SD-422A (available from Borden Chemical), or formaldehyde polymers with phenol and p-tert-butylphenol, such as DURITE® ESD 556C (available from Border Chemical). The optional hole blocking layer may be applied to the substrate. Any suitable and conventional blocking layer capable of forming an electronic barrier to holes between the adjacent photoconductive layer (or electrophotographic imaging layer) and the underlying conductive surface of the substrate may be selected.

In embodiments, a suitable known adhesive layer, usually situated between the hole blocking layer and the photogenerating layer, can be selected for the photoconductor. Typical adhesive layer materials include, for example, polyesters, polyurethanes, and the like. The adhesive layer thickness can vary, and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As adhesive layer component examples, there can be selected various known substances inclusive of polyesters, copolyesters, polyamides, poly(vinyl butyral), poly(vinyl alcohol), polyurethane, and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

Aspects of the present disclosure relate to a photoconductive imaging member comprised of a supporting substrate, a photogenerating layer thereover, and thereover the photogenerating layer at least one charge transport layer, such as from 1 to about 7 layers, from 2 to about 4 layers, one layer, two layers, and the like, and an overcoating charge transport layer; a photoconductive member with a photogenerating layer of a thickness of from about 1 to about 10 microns; at least one transport layer each of a thickness of from about 5 to about 100 microns; an imaging method and an imaging apparatus containing a charging component; a development component, a transfer component, and a fixing component, and wherein the apparatus contains a photoconductive imaging member comprised of a supporting substrate, and thereover a layer comprised of a Type V titanyl phthalocyanine photogenerating pigment and a charge transport layer or layers, and thereover an overcoating charge transport layer; a member wherein the photogenerating layer contains a TiOPc photogenerating pigment present in an amount of from about 5 to about 95 weight percent; a member wherein the thickness of the photogenerating layer is from about 0.1 to about 4 microns; a member wherein the photogenerating layer contains a polymer binder the same as or similar to the charge transport layer binder; a member wherein the photogenerating layer binder is present in an amount of from about 55 to about 95 percent by weight, and wherein the total of all layer components is about 100 percent; a member wherein the photogenerating component is Type V titanyl phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the photogenerating resinous binder is selected from the group consisting of polyesters, polyvinyl butyrals, polycarbonates, polystyrene-b-polyvinyl pyridine, and polyvinyl formals; a photoconductor wherein at least one or each of a plurality of the charge transport layers comprises hole transport molecules, such as the aryl amines illustrated herein, and more specifically, of the structure/formula

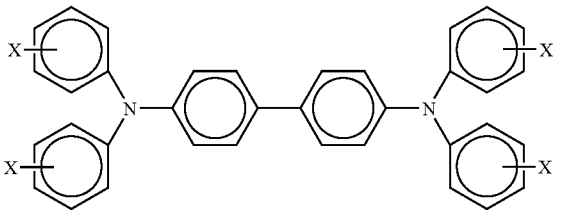

wherein each X substituent, which can be located in the para or meta positions, is selected from the group consisting of at least one of alkyl, alkoxy, substituted alkyl, substituted alkoxy, and halogen; wherein at least one charge transport layer is one, from one to about 5, 1, 2, 3, 4, 5, and the like; an imaging member wherein alkyl and alkoxy contain from about 1 to about 15 carbon atoms; an imaging member wherein for the charge transport aryl amines alkyl contains from about 1 to about 5 carbon atoms; an imaging member wherein each of or at least one of the charge transport layers comprises

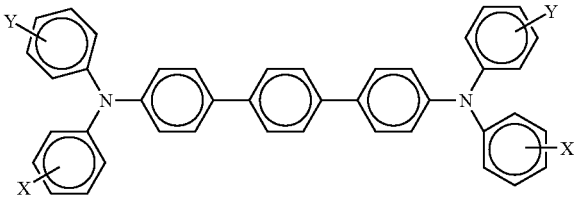

wherein X and Y are independently alkyl, alkoxy, aryl, substituted alkyl, substituted alkoxy, substituted aryl, a halogen such as fluoride, chloride, bromide or iodide, or mixtures thereof; an imaging member wherein alkyl and alkoxy contain from about 1 to about 12 carbon atoms; a photoconductive imaging member wherein for each charge transport layer there is selected in a suitable effective amount an aryl terphenyl amine selected from the group consisting of N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, other known terphenyls, and mixtures thereof; a photoconductive imaging member comprised of a supporting substrate, and thereover a layer comprised of titanyl phthalocyanine Type V photogenerating pigments, and charge transport layers; a member wherein the photogenerating layer is situated between the substrate and the charge transport; a member wherein the charge transport layer is situated between the substrate and the photogenerating layer; a member wherein the photogenerating layer is of a thickness of from about 0.1 to about 45 microns; a member wherein the photogenerating component amount is from about 20 weight percent to about 90 weight percent, and wherein the photogenerating pigment is optionally dispersed in from about 10 weight percent to about 80 weight percent of a polymer binder; a member wherein the thickness of the photogenerating layer is from about 1 to about 12 microns; a member wherein the photogenerating and charge transport layer components are contained in a polymer binder; a member wherein the binder is present in an amount of from about 55 to about 95 percent by weight, and wherein the total of the layer components is about 100 percent; an imaging member with a blocking layer contained as a coating on a substrate, and an adhesive layer coated on the blocking layer; an imaging member further containing an adhesive layer and a hole blocking layer; and a color imaging method which comprises generating an electrostatic latent image on the imaging member, developing the latent image, transferring, and fixing the developed electrostatic image to a suitable substrate.

Examples of components or materials optionally incorporated into the charge transport layers or at least one charge transport layer to, for example, enable excellent lateral charge migration (LCM) resistance include hindered phenolic antioxidants such as tetrakis methylene(3,5-di-tert-butyl-4-hydroxy hydrocinnamate) methane (IRGANO® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER® TPS (available from Sumitomo Chemical Co., Ltd.); thioether antioxidants such as SUMILIZER® TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20, from about 1 to about 10, or from about 3 to about 8 weight percent.

The following Examples are being submitted to illustrate embodiments of the present disclosure. These Examples are intended to be illustrative only and are not intended to limit the scope of the present disclosure. Also, parts and percentages are by weight unless otherwise indicated.

EXAMPLE I

Preparation of Type I Titanyl Phthalocyanine

A Type I titanyl phthalocyanine (TiOPc) was prepared as follows. To a 300 milliliter three-necked flask fitted with mechanical stirrer, condenser and thermometer maintained under an argon atmosphere were added 3.6 grams (0.025 mole) of 1,3-diiminoisoindoline, 9.6 grams (0.075 mole) of o-phthalonitrile, 75 milliliters (80 weight percent) of N-methyl pyrrolidone and 7.11 grams (0.025 mole) of titanium tetrapropoxide (all obtained from Aldrich Chemical Company, except phthalonitrile which was obtained from BASF). The resulting mixture (20 weight percent of solids) was stirred and warmed to reflux (about 198° C.) for 2 hours. The resultant black suspension was cooled to about 150° C., and then was filtered by suction through a 350 milliliter M-porosity sintered glass funnel, which had been preheated with boiling dimethyl formamide (DMF). The solid Type I TiOPc product resulting was washed with two 150 milliliter portions of boiling DMF and the filtrate, initially black, became a light blue-green color. The solid was slurried in the funnel with 150 milliliters of boiling DMF and the suspension was filtered. The resulting solid was washed in the funnel with 150 milliliters of DMF at 25° C., and then with 50 milliliters of methanol. The resultant shiny purple solid was dried at 70° C. overnight, about 18 hours, to yield 10.9 grams (76 percent) of pigment, which was identified as Type I TiOPc on the basis of its X-ray powder diffraction trace. Elemental analysis of the product indicated C., 66.54; H, 2.60; N, 20.31; and Ash ($TiO_2$), 13.76. TiOPc requires (theory): C, 66.67; H, 2.80; N, 19.44; and Ash, 13.86.

A Type I titanyl phthalocyanine can also be prepared in 1-chloronaphthalene as follows. A 250 milliliter three-necked flask fitted with mechanical stirrer, condenser and thermometer maintained under an atmosphere of argon was charged with 1,3-diiminoisoindolene (14.5 grams), titanium tetrabutoxide (8.5 grams), and 75 milliliters of 1-chloronaphthalene (ClNp). The mixture was stirred and warmed. At 140° C. the mixture turned dark green and began to reflux. At this time the vapor (which was identified as n-butanol by gas chromatography) was allowed to escape to the atmosphere until the reflux temperature reached 200° C. The reaction was maintained at this temperature for two hours then was cooled to 150° C. The product was filtered through a 150 milliliter M-porosity sintered glass funnel, which was preheated to approximately 150° C. with boiling DMF, and then washed thoroughly with three portions of 150 milliliters of boiling DMF, followed by washing with three portions of 150 milliliters of DMF at room temperature, and then three portions of 50 milliliters of methanol, thus providing 10.3 grams (72 percent yield) of a shiny purple pigment, which was identified as Type I TiOPc by X-ray powder diffraction (XRPD).

EXAMPLE II

Preparation of Type V Titanyl Phthalocyanine

Fifty grams of TiOPc Type I, prepared above, were dissolved in 300 milliliters of a trifluoroacetic acid/methylene chloride (1/4, volume/volume) mixture for 1 hour in a 500 milliliter Erlenmeyer flask with a magnetic stirrer. At the same time, 2,600 milliliters of methanol/methylene chloride (1/1, volume/volume) quenching mixture was cooled with a dry ice bath for 1 hour in a 3,000 milliliter beaker with a magnetic stirrer, and the final temperature of the mixture was about −25° C. The resulting TiOPc solution was transferred to a 500 milliliter addition funnel with a pressure-equalization arm, and added into the cold quenching mixture over a period of 30 minutes. The mixture obtained was then allowed to stir for an additional 30 minutes, and subsequently hose-vacuum filtered through a 2,000 milliliter Buchner funnel with fibrous glass frit of from about 4 to about 8 μm in porosity. The pigment resulting was then well mixed with 1,500 milliliters of methanol in the funnel, and vacuum filtered. The pigment was then well mixed with 1,000 milliliters of hot water (>90° C.), and vacuum filtered in the funnel four times. The pigment was then well mixed with 1,500 milliliters of cold water, and vacuum filtered in the funnel. The final water filtrate was measured for conductivity, which was below about 10 μS. The resulting wet cake contained approximately 50 weight percent of water. A small portion of the wet cake was dried at 65° C. under vacuum and a blue pigment was obtained. A representative XRPD of this pigment after quenching with methanol/methylene chloride was identified by XRPD as Type Y titanyl phthalocyanine.

The remaining portion of the wet cake was redispersed in 700 grams of monochlorobenzene (MCB) in a 1,000 milliliter bottle and rolled for one hour. The dispersion resulting was vacuum filtered through a 2,000 milliliter Buchner funnel with a fibrous glass frit of from about 4 to about 8 μm in porosity over a period of two hours. The pigment was then well mixed with 1,500 milliliters of methanol and filtered twice in the funnel. The final pigment was vacuum dried at, for example, from about 60° C. to about 65° C. for two days. Approximately 45 grams of the pigment were obtained. The XRPD of the resulting pigment after the MCB conversion indicated that the pigment was Type V titanyl phthalocyanine. The Type V had an X-ray diffraction pattern having characteristic diffraction peaks at a Bragg angle of 2Θ±0.2° at about 9°, 9.6°, 24°, and 27.2°.

COMPARATIVE EXAMPLE 1

Preparation of Titanyl Phthalocyanine Imaging Member Using Tetrahydrofuran as a Solvent An imaging member incorporating a TiOPc Type V pigment was prepared in accordance with the following procedure. A TiOPc dispersion was prepared by ball milling 0.60 gram of TiOPc pigment (obtained in Example II), 0.113 gram of LUPILON™ 200 (PC-Z 200) polymer available from Mitsubishi Gas Chemical Corporation, and 11.2 grams of tetrahydrofuran in a 30 milliliter glass bottle containing 70 grams of approximately ⅛ inch stainless steel balls. The bottle was put on a roll mill and milled for 2 hours. Four grams of the resulting milled pigment dispersion from each bottle was transferred to a second bottle, and further diluted with a solution of 3 grams of tetrahydrofuran and 0.19 gram of PC-Z200 to form a final coating dispersion to be used for preparing the charge generator layer.

The resulting TiOPc dispersion was coated using a Bird's bar (0.00025 inch gap) onto a titanium metallized polyethylene naphthalate sheet, which had a 400 A silane blocking layer, thereover, and a 200 Å (Angstroms thick) polyester. The coated device was dried at 100° C. for 10 minutes.

A transport layer solution was prepared by mixing 6.34 grams of N,N'-diphenyl-N,N'-bis(3-methylphenyl)-1,1-biphenyl-4,4'-diamine, 6.34 grams of polycarbonate resin (available as MAKROLON® 5705 from Bayer A.G.), and 72 grams of methylene chloride. The transport solution was coated onto the above photogenerating layer using a Bird's bar of 5 mil gap. The resulting member was dried at 120° C. in a forced air oven for 1 minute. The final dried thickness of the transport layer was about 29 microns.

COMPARATIVE EXAMPLE 2

Imaging Member from Aged Dispersion (Tetrahydrofuran)

The final TiOPc coating dispersion of Comparative Example 1 was allowed to age for 7 days and re-coated again to form an imaging member or photoconductor in accordance with the Comparative Example 1 procedure.

EXAMPLE III

Preparation of Titanyl Phthalocyanine Imaging Member Using 1,2-Dichloroethane as a Solvent A photoconductor member was prepared by repeating the process of Comparative Example 1 except that the photogenerating layer dispersion was prepared using 1,2-dichloroethane in place of tetrahydrofuran.

EXAMPLE IV

Imaging Member from Aged Dispersion (1,2-Dichloroethane)

The final TiOPc coating dispersion of Example III was allowed to age for 7 days. An imaging member was prepared by repeating the process of Example III.

EXAMPLE V

Preparation of Titanyl Phthalocyanine Imaging Member Using 1,2-Dichloropropane as a Solvent An imaging member was prepared by repeating the process of Comparative Example 1 except that the photogenerating layer dispersion was prepared using 1,2-dichloropropane in place of tetrahydrofuran.

EXAMPLE VI

Imaging Member from Aged Dispersion (1,2-Dichloropropane)

The final TiOPc coating dispersion from Example V was allowed to age for 7 days. An imaging member was then prepared by repeating the process of Example V.

EXAMPLE VII

Preparation of Titanyl Phthalocyanine Imaging Member Using Dichloromethane as a Solvent An imaging member was prepared by repeating the process of Comparative Example 1 except that the photogenerating layer dispersion was prepared using dichloromethane in place of tetrahydrofuran.

EXAMPLE VIII

Imaging Member from Aged Dispersion (Dichloromethane)

The final coating dispersion from Example VII was allowed to age for 7 days. An imaging member was then prepared by repeating the process of Example VII.

EXAMPLE IX

Preparation of Titanyl Phthalocyanine Imaging Member Using 1,1,1-Trichloroethane as a Solvent A photogenerating dispersion was prepared according to the procedure described in Comparative Example 1 with the exception that the solvent selected was 1,1,1-trichloroethane. However, the pigment dispersion obtained was not stable, agglomerated quickly, and settled out from the solvent. A uniform coating of the photogenerator layer on the substrate and fabrication of an imaging member was not obtainable.

EXAMPLE X

Preparation of Titanyl Phthalocyanine Imaging Member Using 1,1,2-Trichloroethane as a Solvent A photogenerating dispersion was prepared according to the procedure described in Comparative Example 1 with the exception that the solvent selected was 1,1,2-trichloroethane. Similar to Example IX, the pigment dispersion obtained was not stable, agglomerated quickly, and settled out from the solvent. No suitable imaging member would be fabricated.

Xerographic Evaluation of Imaging Members

The xerographic electrical properties of the imaging members were determined by known means, including as indicated herein electrostatically charging the surfaces thereof with a corona discharge source until the surface potentials, as measured by a capacitively coupled probe attached to an electrometer, attained an initial value $V_0$ of about −800 volts. After resting for a 0.5 second in the dark, the charged members attained a surface potential of $V_{ddp}$, dark development potential. The photoconductive imaging members were then exposed to light from a filtered Xenon lamp with a 150 watt bulb, thereby inducing a photodischarge which resulted in a reduction of surface potential to a $V_{bg}$ value, background potential. The wavelength of the incident light was 780 nanometers, and the exposure energy of the incident light varied from 0 to 15 ergs/cm$^2$. The dark decay (D.D.) value was calculated according to the equation, $D.D.=2\times(V_0-V_{ddp})$. By plotting the surface potential against exposure energy, a photodischarge curve was constructed. The photosensitivity of the imaging member can be described in terms of $E_{1/2}$, (half-discharge exposure energy), that is the amount of exposure energy in erg/cm$^2$ required to achieve 50 percent photodischarge from the dark development potential.

Table 1 summarizes the xerographic electricals of the above prepared photoconductors or imaging members indicating that the variation in photosensitivity depends on the aging of the dispersion and the type of solvent used in preparing the dispersions.

TABLE 1

Photosensitivity of Imaging Members

| Imaging Member | Solvent for Pigment Dispersion | Aging Time of Dispersion, Days | Half-Discharge Exposure Energy $E_{1/2}$, erg/cm$^2$ |
|---|---|---|---|
| Comparative Example 1 | Tetrahydrofuran | 0 | 0.99 |
| Comparative Example 2 | Tetrahydrofuran | 7 | 2.67 |
| Example III | 1,2-Dichloroethane | 0 | 0.81 |
| Example IV | 1,2-Dichloroethane | 7 | 1.00 |
| Example V | 1,2-Dichloropropane | 0 | 0.89 |
| Example VI | 1,2-Dichloropropane | 7 | 1.00 |
| Example VII | Dichloromethane | 0 | 0.87 |
| Example VIII | Dichloromethane | 7 | 2.98 |

For members coated with fresh dispersions, for example zero days of aging, the photosensitivity was high as indicated by low $E_{1/2}$ values, about 0.8 to 1 erg/cm$^2$. The devices coated from dispersions aged for 7 days showed a large difference in photosensitivity. The use of tetrahydrofuran and dichloromethane exhibited a photoconductor loss in photosensitivity as $E_{1/2}$ values of these photoconductors increased by about 200 percent to about 2.7 to 3. Dichloroethane and dichloropropane showed a much smaller change in photosensitivity as $E_{1/2}$ values only increased by 10 to 20 percent. These results indicate that the use of dichloroethane and dichloropropane preserved the high sensitivity character of TiOPc Type V even after 7 days of dispersion aging.

Optical absorption spectra of TiOPc imaging members were obtained using Shimadzu Model UV-160 spectrophotometer in the wavelength region of from 400 to 1,000 nanometers. The variation of optical absorption spectrum with aging time provided some qualitative indication of the polymorphic (crystal structure) stability of TiOPc dispersion. For example, a shift of absorption peak position would indicate a polymorphic change. Table 2 summarizes the optical spectral results obtained for the imaging members.

TABLE 2

Optical Spectra of Imaging Members

| Imaging Member | Solvent for Pigment Dispersion | Aging Time of Dispersion, Days | High λ Peak Position, nm |
|---|---|---|---|
| Comparative Example 1 | Tetrahydrofuran | 0 | 800 |
| Comparative Example 2 | Tetrahydrofuran | 7 | 890 |
| Example III | 1,2-Dichloroethane | 0 | 810 |
| Example IV | 1,2-Dichloroethane | 7 | 830 |
| Example V | 1,2-Dichloropropane | 0 | 810 |
| Example VI | 1,2-Dichloropropane | 7 | 810 |
| Example VII | Dichloromethane | 0 | 820 |
| Example VIII | Dichloromethane | 7 | 890 |

Compared to the respectively fresh dispersions at zero days, a large shift of magnitude 70 to 90 nanometers in peak position was noticed for the 7 day aged dispersions coated from two solvents, tetrahydrofuran and dichloromethane, indicating a polymorphic change in the TiOPc pigment. For dichloropropane and dichloroethane, the shift of peak position was much smaller at about 0 to 20 nanometers, and hence the polymorphic change was minimum after dispersion aging; these two solvents are suitable for maintaining the crystal structure of high sensitivity TiOPc pigment.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising an optional supporting substrate, a photogenerating layer, and at least one charge transport layer comprised of at least one charge transport component, and wherein said photogenerating layer contains a titanyl phthalocyanine prepared by dissolving a Type I titanyl phthalocyanine in a solution comprising a trihaloacetic acid and an alkylene halide; adding said mixture comprising the dissolved Type I titanyl phthalocyanine to a solution comprising an alcohol and an alkylene halide thereby precipitating a Type Y titanyl phthalocyanine; and treating said Type Y titanyl phthalocyanine with a monohalobenzene resulting in titanyl phthalocyanine with an X-ray diffraction pattern having characteristic diffraction peaks at a Bragg angle 2Θ±0.2° at about 9°, 9.6°, 24°, and 27.2°, and wherein said photogenerating layer is prepared from a dispersion of said titanyl phthalocyanine, a polymer binder, and a chlorinated solvent of at least one of 1,2-dichloroethane, 1,2-dichloropropane, or dichloromethane.

2. A photoconductor in accordance with claim 1 wherein said solution comprising an alcohol and an alkylene halide has an alcohol to alkylene halide ratio of from about 1/4 (v/v) to about 4/1 (v/v), and said titanyl phthalocyanine is Type V titanyl phthalocyanine, and wherein the resulting Type V titanyl phthalocyanine has an X-ray diffraction pattern having characteristic diffraction peaks at a Bragg angle 2Θ±0.2° at about 9°, 9.6°, 24°, and 27.2°, and wherein said solution comprising an alcohol and an alkylene halide comprises methanol and methylene chloride.

3. A photoconductor in accordance with claim 1 wherein said monohalobenzene is monochlorobenzene.

4. A photoconductor in accordance with claim 1 wherein said solvent is 1,2-dichloroethane or 1,2-dichloropropane, and said titanyl phthalocyanine is prepared by dissolving a Type I titanyl phthalocyanine in a solution of trifluoroacetic acid and methylene chloride; precipitating a Type Y titanyl phthalocyanine by adding said solution of trifluoroacetic acid, methylene chloride and the Type I titanyl phthalocyanine to a solution of methanol and methylene chloride; washing said Type Y titanyl phthalocyanine; and wherein said monohalobenzene is monochlorobenzene.

5. A photoconductor in accordance with claim 1 wherein said solvent is 1,2-dichloroethane selected in an amount of from about 80 weight percent to about 98 weight percent of said titanyl phthalocyanine dispersion.

6. A photoconductor in accordance with claim 1 wherein said solvent is 1,2-dichloropropane selected in an amount of from about 80 weight percent to about 98 weight percent of said titanyl phthalocyanine dispersion.

7. A photoconductor in accordance with claim 1 wherein said charge transport contains an aryl amine selected from the group consisting of at least one of N,N'-diphenyl-N,N-bis(3-methylphenyl)-1,1'-biphenyl-4,4'-diamine, N,N'-diphenyl-N,N-bis(4-methylphenyl)-1,1'-biphenyl-4,4'-diamine, and N,N'-diphenyl-N,N-bis(2-methylphenyl)-1,1'-biphenyl-4,4'-diamine, and N,N,N'N'-tetra(4-methylphenyl)-(1,1'-biphenyl)-4,4'-diamine.

8. A photoconductor in accordance with claim 1 further including in said charge transport layer an antioxidant comprised of at least one of a hindered phenolic and a hindered amine.

9. A photoconductor in accordance with claim 1 further including a hole blocking layer, and an adhesive layer.

10. A photoconductor in accordance with claim 1 wherein said substrate is present, and is comprised of a flexible belt.

11. A photoconductor in accordance with claim 1 wherein said photogenerating dispersion contains from about 1 weight percent to about 10 weight percent of said obtained titanyl phthalocyanine Type V; from about 80 weight percent to about 98 weight percent of said chlorinated solvent; and from about 1 weight percent to about 10 weight percent of said polymer binder.

12. A photoconductor in accordance with claim 1 wherein said photogenerating dispersion contains from 2 weight percent to about 6 weight percent of said obtained titanyl phthalocyanine Type V; from 90 weight percent to about 96 weight percent of said chlorinated solvent; and from 2 weight percent to about 6 weight percent of polymer binder.

13. A photoconductor in accordance with claim 1 wherein said at least one charge transport layer is comprised of a top charge transport layer and a bottom charge transport layer, and wherein said top layer is in contact with said bottom layer and said bottom layer is in contact with said photogenerating layer.

14. A photoconductor in accordance with claim 13 wherein said top layer is comprised of at least one charge transport component, a resin binder, and an antioxidant, and said bottom layer is comprised of at least one charge transport component, a resin binder, and an antioxidant.

15. A photoconductor in accordance with claim 1 wherein said photogenerating layer and said charge transport layer further comprise a polycarbonate binder.

16. A photoconductor in accordance with claim 1 wherein at least one charge transport layer is from 1 to about 4.

17. A photoconductor in accordance with claim 1 wherein at least one charge transport layer is 1.

18. A photoconductor in accordance with claim 1 wherein said chlorinated solvent is dichloroethane.

19. A photoconductor in accordance with claim 1 wherein said chlorinated solvent is dichloropropane.

20. A photoconductor in accordance with claim 1 further containing in said photogenerating layer a second photogenerating pigment.

21. A photoconductor in accordance with claim 20 wherein said second pigment is a hydroxygallium phthalocyanine, or a chlorogallium phthalocyanine.

22. A photoconductor consisting essentially in sequence of a substrate, a photogenerating layer thereover, and a charge transport layer, and wherein said photogenerating layer contains titanyl phthalocyanine Type V, a polymer binder, and at least one of a chlorinated solvent of dichloroethane and dichloropropane, deposited on said substrate, wherein said Type V has an X-ray diffraction pattern having characteristic diffraction peaks at a Bragg angle 2Θ ±0.2° at about 9°, 9.6°, 24°, and 27.2°, and wherein said photogenerating dispersion contains from about 1 weight percent to about 10 weight percent of said titanyl phthalocyanine; from about 80 weight percent to about 98 weight percent of said chlorinated solvent; and from about 1 weight percent to about 10 weight percent of said polymer binder.

23. A photoconductor in accordance with claim 22 wherein said charge transport comprises aryl amines of the formula/structure

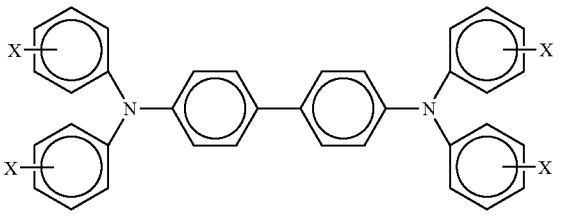

wherein each X is independently alkyl, alkoxy, aryl and a halogen, and mixtures thereof.

24. A photoconductor in accordance with claim 22 where said charge transport comprises

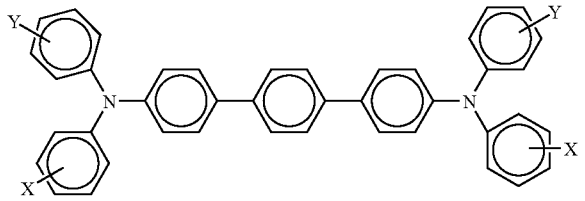

wherein X and Y are independently alkyl, alkoxy, aryl, a halogen, and mixtures thereof.

25. A photoconductor in accordance with claim 22 further including a hole blocking layer and an adhesive layer wherein said adhesive layer is situated between said charge transport and said photogenerating layer, and wherein said charge transport contains hole transport molecules, and a polymer binder.

26. A photoconductor in accordance with claim 22 wherein said transport layer contains hole transport molecules present in an amount of from about 30 to about 70 weight percent.

27. A photoconductor in accordance with claim 22 wherein said dichloroethane and said dichloropropane is at least one of 1,2-dichloroethane, 1,2-dichloropropane, 1,3-dichloropropane, 1,2-dichlorobutane, 2,3-dichlorobutane, and 1,3-dichlorobutane.

28. A process for the preparation of a photoconductor member which comprises depositing on a substrate a photogenerating layer generated from a dispersion of a mixture of a titanyl phthalocyanine Type V photogenerating pigment prepared by dissolving a Type I titanyl phthalocyanine in a solution comprising a trihaloacetic acid and an alkylene halide; adding said mixture comprising the dissolved Type I titanyl phthalocyanine to a solution comprising an alcohol and an alkylene halide thereby precipitating a Type Y titanyl phthalocyanine; and treating said Type Y titanyl phthalocyanine with a monohalobenzene and a chlorinated solvent of at least one of 1,2-dichloroethane, 1,2-dichloropropane, 1,3-dichloropropane, 1,2-dichlorobutane, 2,3-dichlorobutane; 1,3-dichlorobutane, or dichloromethane; and thereafter coating said photogenerating layer with a charge transport layer, and which Type V has an X-ray diffraction pattern having characteristic diffraction peaks at a Bragg angle $2\Theta \pm 0.2°$ at about 9°, 9.6°, 24°, and 27.2° .

29. A process in accordance with claim 28 wherein said resin binder is a polycarbonate, and said charge transport comprises hole transport molecules and said resin binder, and wherein said polycarbonate is PC (Z) poly(4,4'-cyclohexylidinediphenylene) carbonate with $M_w$ of from 20,000 to 100,000.

* * * * *